US008823291B2

(12) United States Patent
Abs

(10) Patent No.: US 8,823,291 B2
(45) Date of Patent: Sep. 2, 2014

(54) CYCLOTRON ABLE TO ACCELERATE AT LEAST TWO TYPES OF PARTICLES

(75) Inventor: Michel Abs, Bossiere (BE)

(73) Assignee: Ion Beam Applications, S.A., Louvain-la-Neuve (BE)

( * ) Notice: Subject to any disclaimer, the term of this patent is extended or adjusted under 35 U.S.C. 154(b) by 0 days.

(21) Appl. No.: 13/807,989

(22) PCT Filed: Jun. 28, 2011

(86) PCT No.: PCT/EP2011/060835

§ 371 (c)(1),
(2), (4) Date: Jan. 2, 2013

(87) PCT Pub. No.: WO2012/010387

PCT Pub. Date: Jan. 26, 2012

(65) Prior Publication Data

US 2013/0106315 A1 May 2, 2013

(30) Foreign Application Priority Data

Jul. 22, 2010 (EP) ..... 10170531

(51) Int. Cl.
*H05H 13/00* (2006.01)
*H05H 7/18* (2006.01)
*H05H 7/02* (2006.01)

(52) U.S. Cl.
CPC ..... *H05H 7/18* (2013.01); *H05H 13/00* (2013.01); *H05H 7/02* (2013.01)
USPC ..... 315/502; 315/500; 315/501; 315/503; 315/504; 315/505

(58) Field of Classification Search
USPC ..... 313/153; 315/502
See application file for complete search history.

(56) References Cited

U.S. PATENT DOCUMENTS

| | | | | |
|---|---|---|---|---|
| 4,507,616 | A * | 3/1985 | Blosser et al. | 315/502 |
| 4,641,057 | A * | 2/1987 | Blosser et al. | 313/62 |
| 4,949,047 | A * | 8/1990 | Hayward et al. | 315/505 |
| 5,521,469 | A * | 5/1996 | Laisne | 315/502 |
| 6,130,926 | A * | 10/2000 | Amini | 376/194 |
| 6,617,810 | B2 * | 9/2003 | Symons | 315/500 |
| 2009/0140672 | A1 * | 6/2009 | Gall et al. | 315/502 |
| 2013/0127375 | A1 * | 5/2013 | Sliski et al. | 315/502 |
| 2014/0028220 | A1 * | 1/2014 | Bromberg et al. | 315/502 |

* cited by examiner

*Primary Examiner* — Douglas W Owens
*Assistant Examiner* — Srinivas Sathiraju
(74) *Attorney, Agent, or Firm* — Christopher Casieri

(57) ABSTRACT

The present invention relates to a dual-frequency resonant cavity (6) for cyclotron which includes a dee (10), a pillar (20), and a conducting enclosure (40) surrounding the pillar and the dee, an end of the pillar being connected to the base of the conducting enclosure and an opposite end of the pillar (20) supporting the dee (10). The conducting enclosure and the pillar form a transmission line comprising at least three portions (20*a*, 20*b*, 20*c*), each portion having a characteristic impedance ($Z_{c1}$, $Z_{c2}$, $Z_{c3}$). The characteristic impedance $Z_{c2}$ of the intermediate portion (20*b*) is substantially lower than the characteristic impedances $Z_{c1}$ et $Z_{c3}$ of the two other portions (20*a*, 20*b*), which makes it possible to have the cavity resonate according to two modes in order to produce two distinct frequencies, without having to make use of moving components such as for example sliding short-circuits or mobile plates.

The present invention also relates to a method for designing such a resonant cavity, based on the use of electromagnetic— and radio frequency simulation tools.

7 Claims, 8 Drawing Sheets

CYCLOTRON ABLE TO ACCELERATE AT LEAST TWO TYPES OF PARTICLES

This application is a 371 application of PCT/EP2011/060835, filed Jun. 28, 2011, which, in turn, claims priority of European Patent Application No.: 10170531.7, filed on Jul. 22, 2010.

BACKGROUND

The present invention refers to the field of cyclotrons, and in particular to cyclotrons which are able to accelerate several types of charged particles having different charge(q)/mass (m) ratios, such as for example protons (ratio q/m equal to 1), alpha particles (ratio q/m equal to ½) or deutons (ratio q/m also equal to ½).

PRIOR ART

A cyclotron is known from document WO8606924. With reference to FIG. 2of this document, such a cyclotron comprises accelerating electrodes 28, commonly called dees, each one being coupled to a vertical pillar 29, also called stem. Said dee 28 and said stem 29 are surrounded by a conducting enclosure, which, together, form a resonant cavity.

Resonant cavities are generally excited by an RF power source, and the successive passage of the charged particles trough the accelerating gap constituted by the dees and by sectors which are brought at different potentials, produces the acceleration of said particles. The frequency of the applied RF voltage must be equal to the "cyclotron frequency", which is expressed by the following equation:

$$f_{RFcyc} = \frac{q \cdot \vec{B}}{2 * \pi \cdot m},$$

wherein q is the charge of the particle to be accelerated, m is its mass and $\vec{B}$ is the main magnetic field, normal to the median plane of circulation of the particles.

A cyclotron can also operate under harmonic mode: in such case, several oscillations of the RF voltage occur while the particles circulate inside the dee.

In the case of these known cavities, one is in the presence of a $$\frac{\lambda}{4}$$

resonator charged by the dee capacity at one end, its other end being short-circuited. The pillar forms an axial transmission line, substantially behaving like an inductance intended to compensate for the capacitive impedance of the dee in order to minimize the reactive RF power. Depending on the configuration of the cyclotron, the cavities are either laid out asymmetrically or symmetrically with regard to the median plane of circulation of the particles. In the case of an asymmetrical topology (FIG. 1*a* of the present application), the two plates constituting the dee are mechanically and electrically interconnected and constitute only one unit carried by the pillar. In the case of a symmetrical topology (FIG. 1*b* of the present application), inferior and superior pillars respectively support a lower half-dee and a higher half-dee. The latter two are electrically interconnected at some places of their perimeter as soon as the cyclotron is closed.

The dee belongs to a resonant cavity 5, as schematically represented on FIG. 1*a*. This cavity comprises the dee itself 10, a vertical cylindrical pillar 20 and a conducting enclosure 40. FIG. 1*c* represents an equivalent electrical circuit of the cavity, in which the inductance L represents the pillar 20 and the capacity C is that one formed at the level of the space between the dee 10 and the conducting enclosure 40. The resonance frequency of such a parallel LC circuit is given by the expression:

$$f_0 = \frac{1}{2 \cdot \pi \cdot \sqrt{L \cdot C}}$$

In order to be able to accelerate several types of particles having different q/m ratios in a cyclotron—the magnetic field $\vec{B}$ being fixed—several solutions arise:

a) use different harmonic modes, while keeping the same RF frequency, b) use the same harmonic mode, while changing the RF frequency.

The first solution presents the following disadvantages:

- an increased complexity in the central region of the cyclotron,
- at thigh currents, beam losses within the machine will cause the activation of mechanical parts.

On the other hand, the second solution presents the following advantages:

- particles of different mass will have the same centering and will thus follow a similar trajectory, at least in the first revolutions at low energy,
- less beam losses, thereby reducing the activation of mechanical parts located close to the beam trajectory,
- a better gain per revolution for particles whose ratio q/m=1,
- a better isochronism.

The implementation of this second solution forces to be able to modify the resonance frequency of the cavity constituted by the dee, the pillar and the conductive enclosure. Such solutions have been proposed by M. Eiche et al. (<<*Dual Frequency resonator system for a compact cyclotron*>>, Proc. XIII Intern. Conf. on Cyclotrons and Their Applications, (World Scientific, Singapore, 1992, p. 515), by P. Lanz et al. ("*A dual Frequency Resonator*", Proceedings of the 1993 IEEE Particle Accelerator Conference, 17-20 May 1993, Washington, D.C.; 15th IEEE Particle Accelerator Conference, p. 1151), and by Miura Iwao et al. (<<Accelerating Resonance Cavity>>, JP07-066877B, 1995).

The first two authors carry out the change of RF frequency by using sliding short-circuits, actuated by pistons, and intended to modify the length of the resonator. The last author carries out the change of RF frequency thanks to mobile plates swiveling of 90°, which modifies the capacity of the electrodes and thus the resonance frequency.

The change of the resonance frequency requires a relatively complex and expensive RF structure, to which reliability problems are added. Indeed, the prior art devices present a number of disadvantages as listed hereafter:

a. for the mobile short-circuits:
   - the size of the piston is in connection with that of the short-circuit because this one exerts a considerable friction force on the walls of the resonator;
   - the wear caused by the repeated linear movements of the short-circuit during the changes of frequency. In the long term, the degradation of the surface quality of the contacts and/or the wall on which they slip involves the appearance of more resistive points which—since they are traversed by RF currents—cause a local heating;

pure and simple destruction of the short-circuit when the pressure exerted by this one on the walls is not sufficient any more. The case being, the contact resistance becoming too important having regard to RF currents to be transported, this will involve a rise in temperature which can cause the fusion of the contacts.

b. For the mobile plates:

the axis of rotation of the plates requires the crossing of the vacuum part of the cyclotron in order to ensure the connection of said axis to the piston or to the engine which drives it. If the latter were contained in the vacuum, they would nevertheless have to be fed electrically, which requires a crossing of cables towards the outside.

the quality factor of the cavity at the low frequency is rather bad due to important RF currents traversing this mobile capacity. The stability of the frequency can also be problematic.

SUMMARY OF THE INVENTION

A purpose of the present invention is to at least partially address the above mentioned difficulties.

According to a first aspect, the present invention relates to a resonant cavity for the acceleration of charged particles in a cyclotron, comprising a dee, a pillar and a conducting enclosure surrounding at least partially said pillar and said dee, an end of the pillar supporting the dee, the conducting enclosure and the pillar thus forming a transmission line, characterized in that an opposite end of the pillar is attached to a base of the conducting enclosure, and in that the linear capacity of an intermediate portion of the transmission line located between the aforementioned ends of the pillar is substantially larger than the linear capacity of another portion of said transmission line.

When it is said that that an opposite end of the pillar is attached to a base of the conducting enclosure, it must be understood that the aforementioned opposite end of the pillar is mechanically fixed and electrically connected in a fixed way to the base of the enclosure. The pillar thus presents a fixed physical length between its two ends. Since the conducting enclosure also has a fixed physical length, the transmission line formed by the enclosure and the pillar has a fixed length and thus a fixed inductance.

Such a configuration makes it possible to have the cavity resonate according to two different modes, for example a $$\frac{\lambda}{4}$$

mode and a $$\frac{3\lambda}{4}$$

mode, thus producing two distinct RF frequencies, without having to make use of moving components such as for example sliding short-circuits or mobile plates, which solves a number of aforementioned problems.

Preferably, the linear capacity of the intermediate portion of the transmission line is larger than twice the linear capacity of another portion of said transmission line. In more preferred way, the linear capacity of the intermediate portion of the transmission line is larger than ten times the linear capacity of another portion of said transmission line.

In an even more preferred way, the characteristic impedance of the intermediate portion and the characteristic impedances of the other portions of the transmission line are such that the cavity is capable of resonating according to two modes in order to produce two distinct frequencies in a substantially double ratio. By substantially double, one must understand a ratio of frequencies comprised between 1.7 (17/10) and 2.3 (23/10). Such a cavity indeed makes it possible to accelerate, in the same cyclotron, particles having values of q/m in a ratio of two, such as for example protons and alpha particles, or protons and deutons.

In an even more preferred way, the pillar comprises several superimposed cylinders, one of these cylinders corresponding to the aforementioned intermediate portion of the transmission line and having an average diameter substantially higher than the average diameter of one of the other cylinders. Alternatively or jointly, the conducting enclosure comprises several superimposed hollow cylinders, one of these hollow cylinders corresponding to the aforementioned intermediate portion of the transmission line and having an average diameter substantially lower than the average diameter of one of the other hollow cylinders. Such a cylindrical configuration of the pillar and/or of the conducting enclosure indeed make it possible to obtain a good mechanical rigidity of the unit, to facilitate its construction and to ensure a good distribution of electric field equipotentials from the pillar.

According to a second aspect, the invention relates to a method for designing a dual-frequency resonant cavity, as claimed.

These as well as other aspects of the invention will be clarified in the detailed description of particular embodiments of the invention.

BRIEF DESCRIPTION OF THE FIGURES

The figures are indicative and do not constitute a limitation of the present invention. Moreover, the proportions of the drawings are not respected. Identical or similar components are generally indicated by the same reference numbers among the whole of the figures.

Figure 1C:
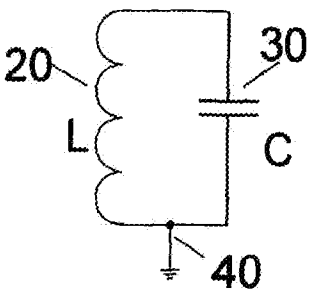
FIG. 1*c* represents a simplified equivalent electrical circuit of the resonant cavity of FIG. 1*a* or 1*b;*
Figure 1B:
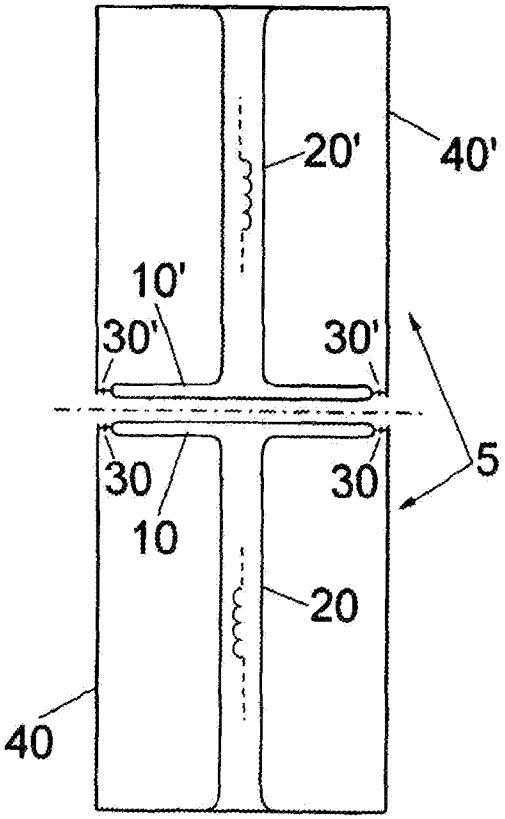
FIG. 1*b* represents a cross section of an symmetrical resonant cavity of a cyclotron of the prior art.
Figure 1A:
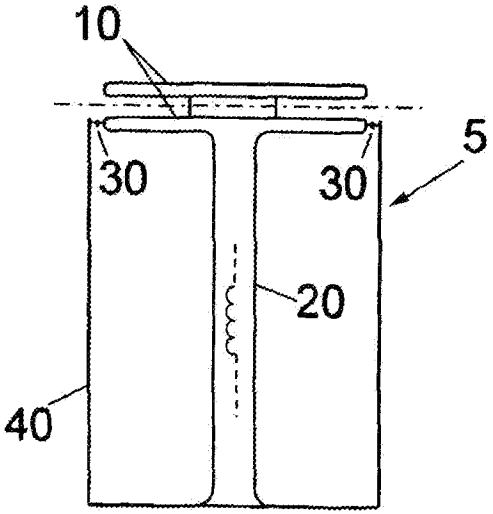
FIG. 1*a* represents a cross section of an asymmetrical resonant cavity of a cyclotron of the prior art.
Figures 2A, 2B, 2C:
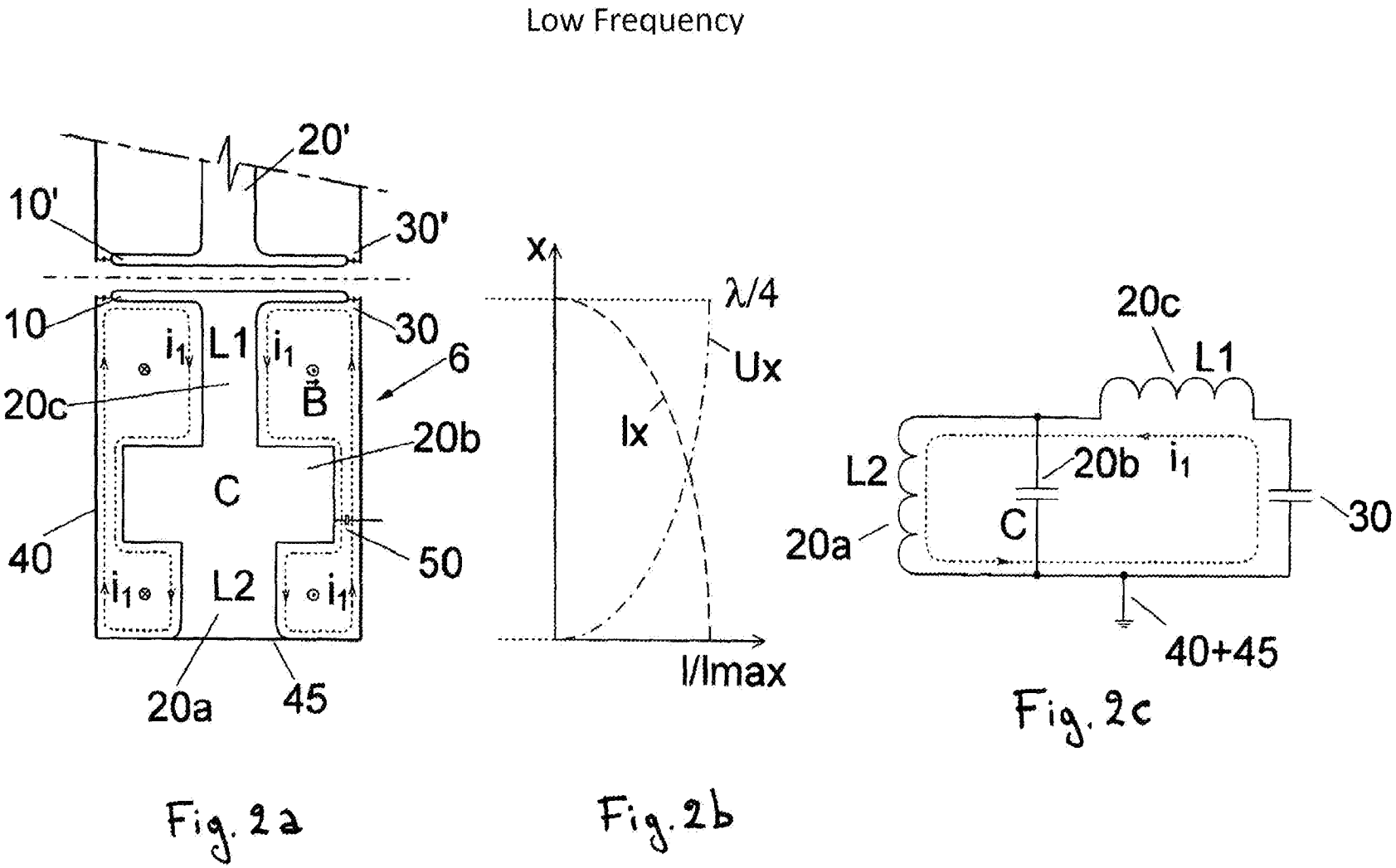
FIG. 2*a* schematically represents a cross section of a cavity according to the invention, with indication of the circulating currents and of the magnetic field when the cavity resonates at the low frequency.
FIG. 2*b* represents the evolution of the voltage and the current along the pillar when the cavity of FIG. 2*a* operates in $$\frac{\lambda}{4}$$

mode;

FIG. 2*c* represents a simplified equivalent electrical circuit of the resonant cavity of FIG. 2*a;*

Figures 3A, 3B, 3C:
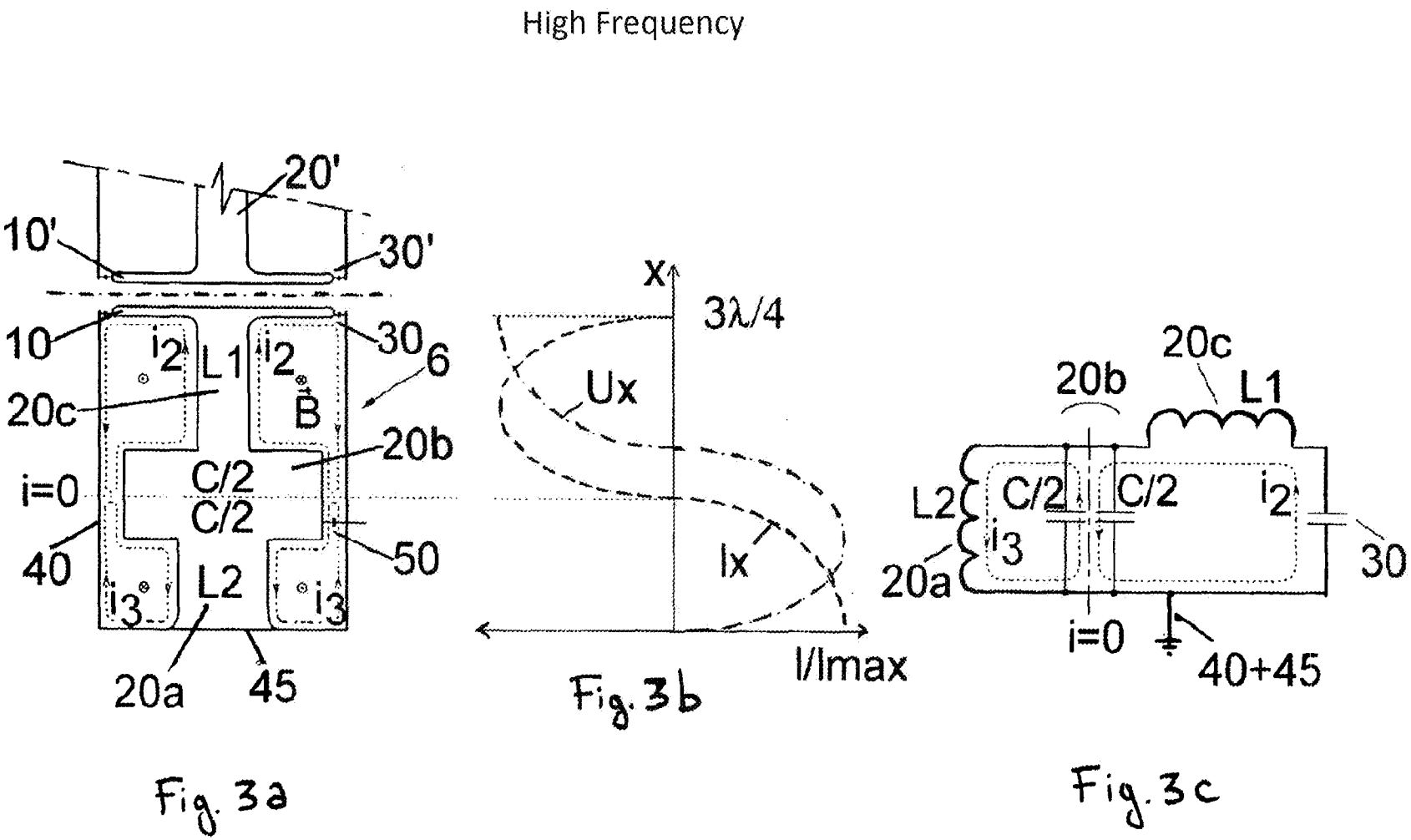

FIG. 3*a* schematically represents a cross section of a cavity according to the invention, with indication of the circulating currents and of the magnetic field when the cavity resonates at the high frequency;

FIG. 3*b* represents the evolution of the voltage and the current along the pillar when the cavity of FIG. 3*a* operates in $$\frac{3\lambda}{4}$$

mode;

FIG. 3*c* represents a simplified equivalent electrical circuit of the resonant cavity of FIG. 3*a;*

Figure 4B:
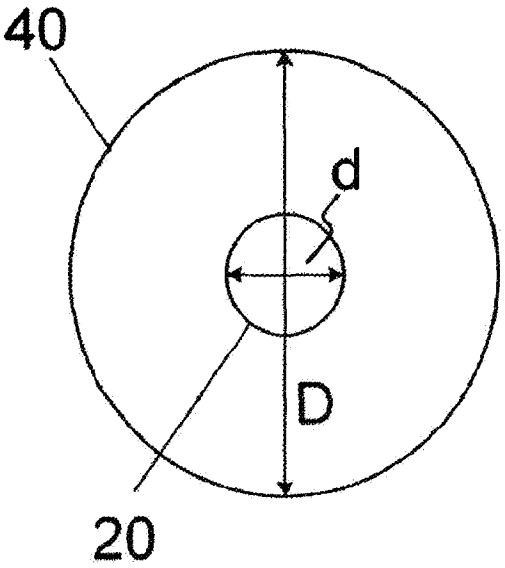
Figure 4A:
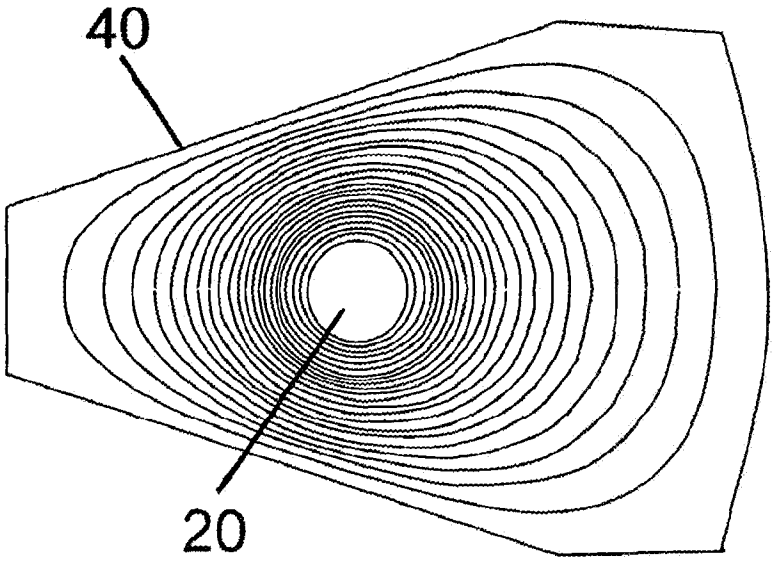
Figure 5:
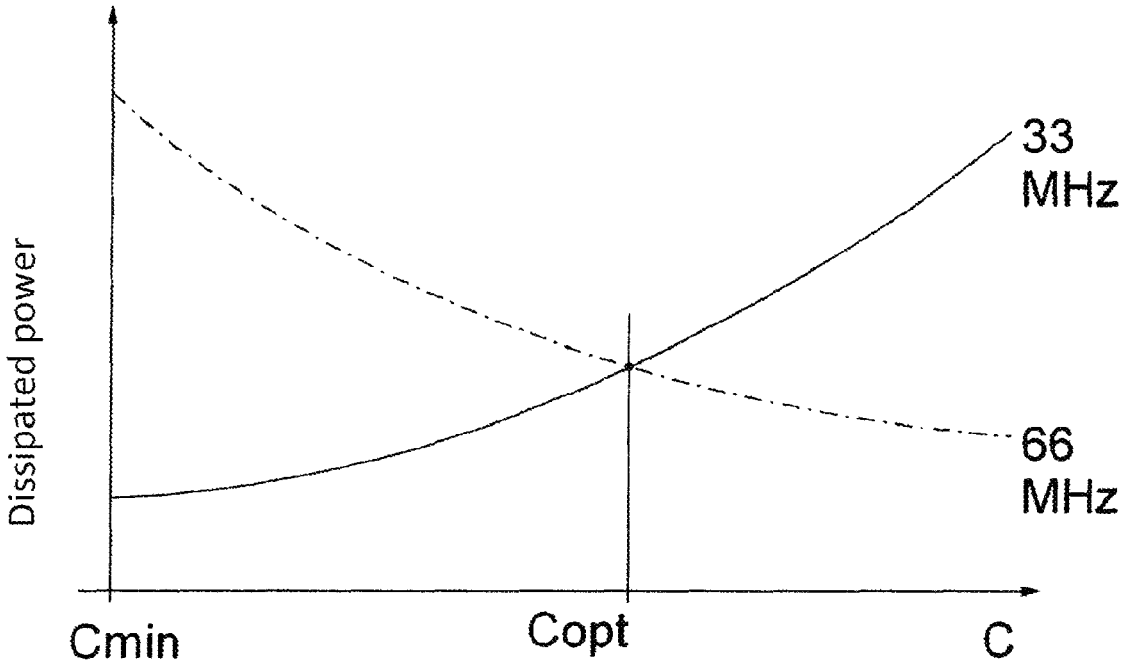
Figure 6B:
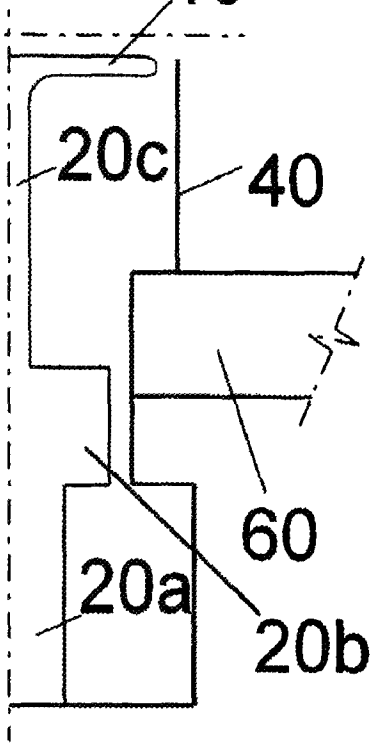
Figure 6A:
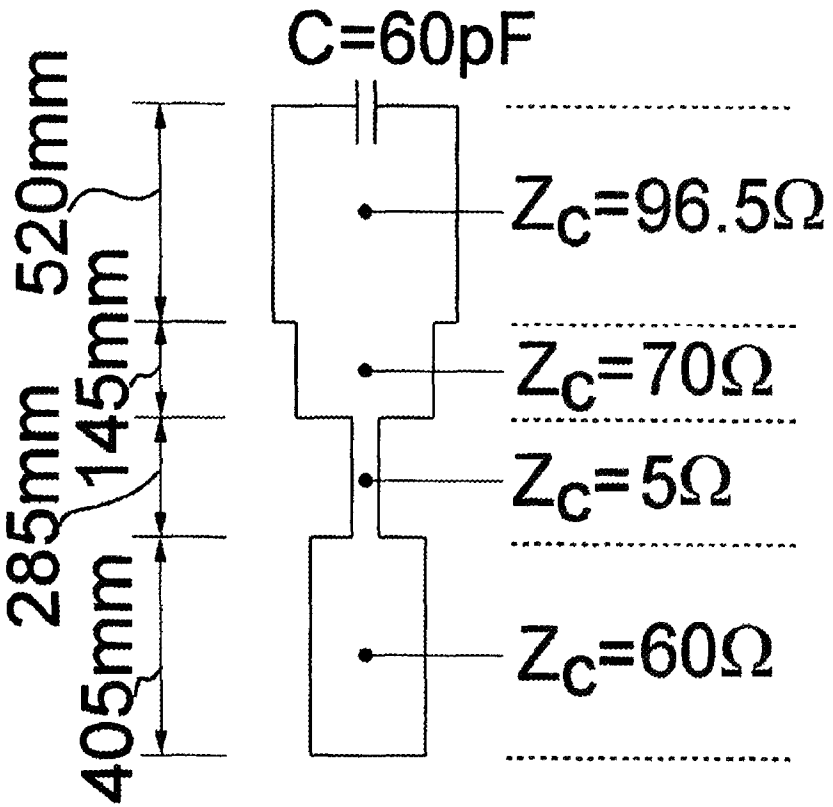

FIG. 4*a* represents a real geometric shape as well as a distribution of the equipotentials of a static electric field of a prior art cavity;

FIG. 4*b* schematizes a prior art cavity in the form of a coaxial transmission line whose characteristic impedance is a function of the diameters d and D;

FIG. 5 is a graph showing the power dissipated in a resonant cavity according to the invention for each of the two resonance frequencies in function of the value of the capacity of the portion of the transmission line with low characteristic impedance;

FIG. 6*a* represents an impedance diagram of a pillar according to an embodiment of the invention;

FIG. 6*b* schematically represents a cross section of a cavity according to the invention, to be put in relation with the impedance diagram of FIG. 6*a;*

Figure 7:
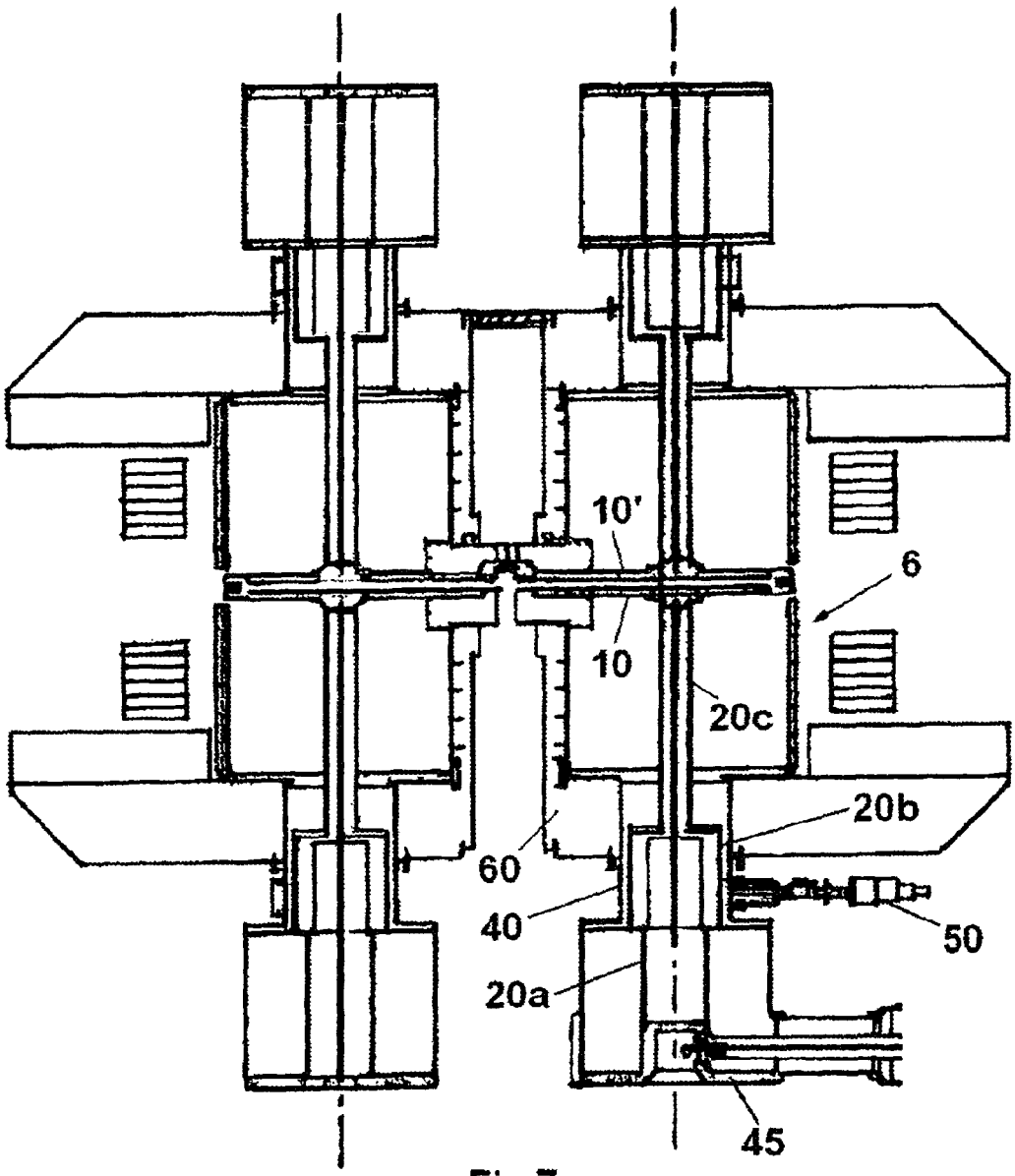
Figure 8:
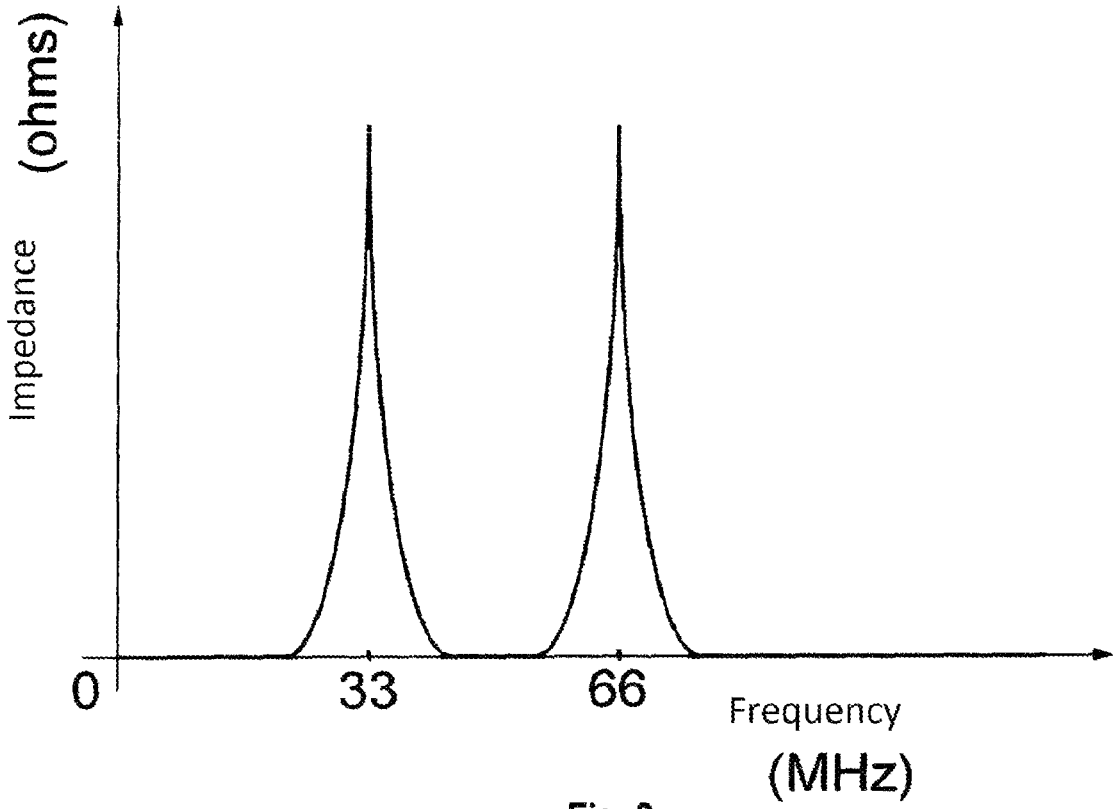

FIG. 7 represents a cross section of a dual frequency cyclotron equipped with four cavities according to the invention;

FIG. 8 schematically represents a graph showing the two distinct frequencies in a ratio of two, obtained by a frequency scanning of a cavity according to the invention.

DETAILED DESCRIPTION OF PREFERRED EMBODIMENTS

FIG. 2*a* schematically represents an exemplary embodiment of a dual frequency cavity according to the invention.

It is a cavity presenting a symmetry with regard to the median plane of the cyclotron (represented by a mixed dashed-dotted line on the figure), but it is obvious that an asymmetrical cavity would also be appropriate. The cavity 6 comprises two half-dees 10 and 10' electrically connected together and between which will circulate the particles to accelerate, two pillars comprising each three portions 20*a*, 20*b* and 20*c* (20*a*', 20*b*' and 20*c*'), and two conducting enclosures 40 and 40' surrounding the whole. The enclosures have a cross section which, in this example, is substantially constant over the height of the pillars. Each pillar respectively supports a half-dee at an end, the opposite ends being respectively connected mechanically and electrically in a fixed way to bases 45 and 45' of the conducting enclosures 40 and 40', to constitute a short-circuit from a radio frequency point of view there. The end of a pillar will for example be welded, screwed or bolted at the base of its conducting enclosure. Alternatively, the pillar and the base of its conducting enclosure will for example be able to form only one part. Each pillar thus presents a fixed length between its two ends.

The various portions of the pillar are superimposed and preferably aligned along the same axis. These portions are made up, in this example, of cylindrical tubes of various diameters, whose exemplary dimensions will be given hereafter when a method of design of a cavity according to the invention is described. The diameter of the intermediate portion 20*b* is substantially larger than the diameter of the two other portions 20*a* and 20*c*, so that the linear capacity (in Farad per meter) of this intermediate portion 20*b* is substantially larger than the linear capacity of the two other portions 20*a* and 20*c*. Consequently, the intermediate portion 20*b* will have a primarily capacitive behavior, whereas the other portions 20*a* and 20*c* will have a primarily inductive behavior, in the frequency band of operation of the cavity (which is in the Megahertz range). A simplified equivalent electric circuit of such a cavity is presented on FIG. 2*c*.

A first type of operation is obtained by exciting the cavity in $$\frac{\lambda}{4}$$

mode (λ being the wavelength), which makes it possible to obtain a first resonance frequency (hereafter "the low resonance frequency", for example 33 MHz).

FIG. 2*b* represents the evolution of voltage (Ux) and current (Ix) in this mode, in function of an axial position x along the pillar. The voltage is maximum at the level of the dee, whereas the current is zero or very small at this location. This is reversed when one is at the foot of the pillar. Such voltage configuration is particularly appropriate to accelerate particles evolving in the median plane of a cyclotron.

The magnetic field $\vec{B}$ is oriented identically on both sides of the intermediate portion 20*b* (hereafter "the low impedance line 20*b*"). The current i1 resulting from this mode circulates axially and is distributed radially around the pillar, as represented in FIG. 2*a*.

A second type of operation is illustrated in FIG. 3*a*. The physical structure is identical to that of FIG. 2*a*, but the $$\frac{3\lambda}{4}$$

mode is excited here, which makes it possible to obtain a second resonance frequency (hereafter "the high resonance frequency", for example 66 MHz), higher than the first frequency. FIG. 3*b* represents the evolution of voltage (Ux) and current (Ix) in this mode and, in a way identical to the first mode of resonance, the voltage is always maximum at the level of the dee, whereas the current is zero or very small at this location. In addition, the current is reversed at an intermediate point located approximately at middle height of the low impedance line 20*b*, which causes to divide by two the capacitive effect of this portion of line 20*b*.

Taking into account what precedes, the magnetic field $\vec{B}$ is in opposition on both sides of this intermediate point. FIG. 3*c* represents a simplified equivalent electric circuit showing the flow of the currents i2 and i3 respectively present in the higher and lower part of the half-cavity. They are distributed radially around the pillar, in opposition compared to a virtual horizontal plan transversely dividing the low impedance line 20*b*, in which they cancel each other.

It will appear obvious for the skilled person that many other geometrical configurations of the cavity are possible, provided an intermediate portion of the cavity has a linear capacity which is substantially higher than the linear capacity of the other portions, preferably higher than twice the linear capacity of the other portions, even more preferably higher than ten times the linear capacity of the other portions. One could for example alternatively envisage a pillar of constant section on its height and a conducting enclosure presenting an intermediate portion whose section is substantially smaller than that of the other portions. One could also envisage a combination of these two solutions, namely an enclosure comprising an intermediate contracting and a pillar comprising an intermediate widening, such as for example illustrated on FIGS. 6*b* and 7, or any other combination.

A calculation method for designing and dimensioning a structure of a cavity according to the invention is provided hereafter.

Prior to the calculation of the dual frequency cavity according to the invention, a modeling of a known cavity as described in document WO8606924—i.e. a cavity whose pillar and conducting enclosure present a constant section—is carried out according to a method described hereafter so as to precisely determine the diameter of an equivalent dee, presumed circular, and the impedance of the pillar of such a known cavity:

1. calculation of the linear capacity of the pillar of a cavity whose pillar and conducting enclosure present a constant section, making it possible to deduce the characteristic impedance of the transmission line thus formed by aforementioned pillar and conducting enclosure;
2. calculation of the characteristic impedance for various diameters of pillar;
3. determination of the equivalent average external diameter of the conducting enclosure;
4. electromagnetic simulation in 2D of the cavity, based on the previously found dimensions, and determination of the diameter of an equivalent dee, presumed circular, producing the same resonance frequency as the aforementioned prior art cavity;
5. calculation of the intrinsic parameters of the cavity, such as the quality factor Q., dissipated power, stored energy, and comparison between these results and measured values.

Details of Step 1

One evaluates the characteristic impedance of the known pillar, for example using the Tricomp program of the company Field Precision LLC. This program solves the electric field by the finite element method. FIG. 4*a* shows for example the distribution of the electric field equipotentials obtained by applying a voltage of 1 V to a known pillar of diameter d=90 mm, while the conducting enclosure is at the potential of the mass. One obtains a stored energy of 18.53 pJ/m.

One then obtains the value of the capacity C from the expression:

$$E = \frac{C \cdot V^2}{2},$$

which gives C=37.06 pF/m in the present exemplary case.

Next, by combining the following two expressions:

$$Z_C = \sqrt{L/C} \text{ and } c_0 = \frac{1}{\sqrt{L \cdot C}},$$

where $c_0$=the speed of light, one can express the characteristic impedance $Z_c$ under the form:

$$Z_C = \frac{1}{C \cdot c_0},$$

from which one obtains a value of $Z_c$ of 90.1 ohm in the present exemplary case.

Details of Step 2

The same calculation of characteristic impedance is carried out for other pillar diameters. One then obtains for example the following values:

for d=100 mm: C=39.88 pF/m and Zc=83.58 ohms for d=80 mm: C=34.36 pF/m and Zc=97.01 ohms Details of Step 3

The known conducting enclosure not necessarily having a circular section (as one sees it for example on FIG. 4*a* which shows a more or less triangular section for the example of the known enclosure), one then determines an average equivalent diameter D (see FIG. 4*b*) of this conducting enclosure with the following expression:

$$D = d \cdot e^{\left(\frac{Z_C}{60}\right)}$$

in the present exemplary case, this gives D=404.02 mm for a pillar having a diameter d=90 mm.

By furthermore carrying out the same calculation with the data obtained from step 2, one notices that D does almost not vary for various diameters of the pillar. One indeed obtains that D=402.69 for d=100 mm, and that D=402.97 for d=80 mm. We choose in this example the value of D=400 mm (+/−3 mm are allocated to the thickness of copper of the conducting enclosure).

Details of Step 4

In order to determine the diameter of an equivalent dee, presumed circular, producing the same resonance frequency as the aforementioned cavity of the prior art, one carries out a 2D electromagnetic simulation of the cavity based on found previously dimensions, for example by means of the Wavesim program of the company Field Precision LLC. One then proceeds by successive approximations until obtaining the good resonance frequency.

In the case of the example given, one finds an equivalent diameter of the dee of 378 mm for a resonance frequency of $f_0$=66 MHz (measured on the real cavity).

Details of Step 5

One then determines the surface currents in the cavity so as to evaluate the dissipated power and the quality factor. This can for example also be carried out by means of the Wavesim program. For a voltage of 50 kV in the accelerating gap, the power dissipated in a known cavity according to the provided example is of 1300 W and the quality factor Q is 10600. These values will be used as benchmarks for the later steps.

The numerical values obtained in the course of these first five steps allow calculating the structure of a dual frequency cavity according to the invention. The following steps of the calculation method according to the invention relate to, as an example, a cavity according to FIGS. 2*a* and 3*a* exploiting two resonant modes: a first mode at $$\frac{\lambda}{4}$$

for a low frequency of approximately 33 MHz and a second mode at $$\frac{3\lambda}{4}$$

for a high frequency of approximately 66 MHz.

It will be obvious for the skilled person to adapt what it is required to these following stages for other frequencies and/or other frequency ratios.

The shape of a dual frequency cavity according to the invention is determined by several physical components whose following characteristics can be obtained, and preferably optimized, for example using the Genesys radio-frequency simulation software of the company Agilent:

the characteristic impedance and the length of line 20*c;* the characteristic impedance and the length of the low impedance line 20*b*, comparable to a capacitor;

the characteristic impedance and the length of line 20*a*.

Once these elements are determined, one preferably carries out a final optimization of the dual frequency cavity by 2D electromagnetic simulation, for example using the Wavesim software. One examines here the variation of the resonance frequency in function of the variation of the geometrical characteristics of the various portions of the pillar.

In particular, the most delicate point is the optimization of the low impedance line with 20*b*. Indeed, if its capacity is selected too low, dissipation at the high frequency (for example at 66 MHz) is considerable, just as the voltage developed at this location, in certain cases as important as that present on the dee. By increasing the value of the capacity, the voltage decreases, just as the power dissipated at the bottom of the cavity. By taking account of the acceptable maximum value of the electric field as well as of the value of the capacity making it possible to obtain the required frequency ratio, for example a ratio of two (reference point $C_{min}$), one preferably determines an optimal point $C_{opt}$ for which the power dissipation is nearly identical at the two resonance frequencies, such as illustrated on FIG. 5.

A multitude of solutions exist. However certain technical criteria have guided the design of a more preferred cavity according to the invention:

i. to have a pillar whose diameter in the portion 20*c* is equal to or higher than 80 mm, for reasons of mechanical rigidity;

ii. to have an overall length of the pillar which is as short as possible;

iii. to extend the low impedance line 20*b* out of the cylinder head of the cyclotron, thus allowing an optimal RF power injection and an optimum cavity tuning;

iv. to allow an RF excitation power of the cavities which is as low as possible, in particular at the high frequency (for example at 66 MHz), in order to have a reserve for the acceleration of the particle beam.

By applying the above method, one finally obtains the following preferred dimensions for the pillar:

portion 20*c* (in two parts):

first part: diameter=80 mm, length=520 mm, Zc=96.5 ohms;

second part: diameter=80 mm, length=145 mm, Zc=70 ohms;

portion 20*b*: diameter=258 mm, length=285 mm, Zc=5 ohm (low impedance portion)

portion 20*a*: diameter=184 mm, length=405 mm, Zc=60 ohms.

This result is illustrated on FIGS. 6*a* and 6*b*, FIG. 6*a* being a diagram of impedances of the various portions of line constituting the pillar and FIG. 6*b* being a schematic view of a longitudinal section of a corresponding physical embodiment of the exemplary preferred cavity according to the invention (only a half of the cavity is represented).

The overall length of the cavity is 1355 mm, including 600 mm out of the cylinder head 60 of the cyclotron. The low and high resonance frequencies are respectively estimated at 33.094 MHz and 66.486 MHz. The dissipated powers are about 2768 W at 33 MHz for a dee voltage of 25 kV, and 2699 W at 66 MHz for a dee voltage of 50 kV. The quality factors are of 6700 at 33 MHz and of 10000 at 66 MHz.

A practical realization of a cavity according to the invention and its set-up in a cyclotron is illustrated on FIG. 7. The vertical cut of this cyclotron makes it possible to distinguish four cavities according to the invention, of which only one has been annotated for clearness and understanding.

The resonance frequencies of the cavity can be checked by carrying out a frequency sweep ("wobbulation"). This provides a curve of variation of the impedance in function of the frequency, showing two distinct peaks. According to the provided preferred example, one finds a peak at substantially 33 MHz and a second peak at substantially 66 MHz, as schematically shown on FIG. 8.

During its operation, the resonance frequency of the cavity will drift, mainly because of thermal drifts modifying its dimensions. According to prior art, it is known to place a motorized and controlled tuning capacitor in the median plane of the cyclotron, and intended to adjust the RF frequency injected into the cavity. This configuration would however have little effect at the low frequency, for example at 33 MHz.

According to a preferred version of the invention, cavity 6 comprises a tuning capacitor 50 comprising a mobile electrode connected electrically to the conducting enclosure 40, placed opposite the pillar and substantially at the level of the intermediate portion 20*b* of the transmission line. This tuning capacitor 50 is visible on FIG. 7. By simulation, one indeed determined that such a tuning capacitor 50 placed at such a place makes it possible to obtain adjustment amplitudes which are very close at the two resonance frequencies, namely, in the case of a low frequency of 33 MHz and a high frequency of 66 MHz, a variation of 12.6 KHz/pF at 33 MHz and a variation of 12.2 KHz/pF at 66 MHz.

In summary, the invention may also be described as follows: a dual-frequency resonant cavity 6 for cyclotron which includes a dee 10, a pillar 20, and a conducting enclosure 40 surrounding the pillar and the dee, an end of the pillar being connected to the base of the conducting enclosure and an opposite end of the pillar 20 supporting the dee 10. The conducting enclosure and the pillar form a transmission line comprising at least three portions (20*a*, 20*b*, 20*c*), each portion having a characteristic impedance ($Z_{c1}$, $Z_{c2}$, $Z_{c3}$). The characteristic impedance $Z_{c2}$ of the intermediate portion 20*b* is substantially lower than the characteristic impedances $Z_{c1}$ et $Z_{c3}$ of the two other portions (20*a*, 20*b*), which makes it possible to have the cavity resonate according to two modes in order to produce two distinct frequencies, without having to make use of moving components such as for example sliding short-circuits or mobile plates.

The present invention has been described in relation to specific embodiments, which have a purely illustrative value and do not have to be regarded as restrictive. Generally, it will appear obvious for the skilled person that the present invention is not limited to the examples illustrated and/or described above. The invention includes each new characteristic as well as all their combinations. The presence of reference numbers to the drawings cannot be regarded as restrictive, including when these numbers are indicated in the claims. The use of the verbs "to include", "to comprise", or any other alternative, as well as theirs conjugations, can in no way exclude the presence of elements other than those mentioned. The use of the indefinite article "one" or of the definite article "it" to introduce an element does not exclude the presence of a plurality of these elements.

The invention claimed is:

1. A resonant cavity adapted for the acceleration of charged particles in a cyclotron, comprising a dee, a pillar and a conducting enclosure surrounding at least partially said pillar and said dee, an end of said pillar supporting the dee, the conducting enclosure and the pillar thus forming a transmission line, characterized in that an opposite end of said pillar is mechanically fixed and electrically connected in a fixed way to a base of the conducting enclosure, and in that the linear capacity of an intermediate portion of the transmission line located between the aforementioned ends of the pillar is larger than the linear capacity of the other portions of said transmission line that are located between the aforementioned ends of the pillar.

2. A resonant cavity according to claim 1, characterized in that the linear capacity of the intermediate portion of the transmission line is larger than twice the linear capacity of the other portions of said transmission line that are located between the aforementioned ends of the pillar.

3. A resonant cavity according to claim 2, characterized in that the linear capacity of the intermediate portion of the transmission line is larger than ten times the linear capacity of the other portions of said transmission line that are located between the aforementioned ends of the pillar.

4. A resonant cavity according to claim 1, characterized in that the characteristic impedance ($Z_{c2}$) of the intermediate portion and the characteristic impedances ($Z_{c1}$, $Z_{c3}$) of the other portions of the transmission line are such that the cavity is capable of resonating according to two modes in order to produce two distinct frequencies in a substantially double ratio.

5. A resonant cavity according to claim 1, characterized in that the pillar comprises several superimposed cylinders, one of these cylinders corresponding to said intermediate portion of the transmission line and having an average diameter which is substantially larger than the average diameter of anyone of the other cylinders.

6. A resonant cavity according to any of claims 1 to 5, characterized in that the conducting enclosure comprises several superimposed hollow cylinders, one of these hollow cylinders corresponding to said intermediate portion of the transmission line and having an average diameter which is substantially smaller than the average diameter of anyone of the other hollow cylinders.

7. A resonant cavity according to any of claims 1 to 5, characterized in that it furthermore includes a tuning capacitor comprising a mobile electrode connected electrically to the conducting enclosure, placed opposite the pillar and substantially at the level of the intermediate portion of the transmission line.

* * * * *